US007555924B2

(12) United States Patent
Fumagalli

(10) Patent No.: US 7,555,924 B2
(45) Date of Patent: Jul. 7, 2009

(54) BASKET FOR WASHING MACHINE, WASHER-DRIER, DRIER, AND THE LIKE

(75) Inventor: Silvano Fumagalli, Monza (IT)

(73) Assignee: Candy S.p.A., Monza (Milan) (IT)

( * ) Notice: Subject to any disclaimer, the term of this patent is extended or adjusted under 35 U.S.C. 154(b) by 174 days.

(21) Appl. No.: 11/179,567

(22) Filed: Jul. 13, 2005

(65) Prior Publication Data

US 2006/0016229 A1 Jan. 26, 2006

(30) Foreign Application Priority Data

Jul. 22, 2004 (EP) ..... 04225550

(51) Int. Cl.
*D06F 25/00* (2006.01)

(52) U.S. Cl. ..... 68/145; 68/141; 68/146; 68/148

(58) Field of Classification Search ..... 68/141, 68/145, 146, 148
See application file for complete search history.

(56) References Cited

U.S. PATENT DOCUMENTS 886,745 A * 5/1908 Vieman ..... 68/143
3,815,258 A * 6/1974 Beard, Jr. ..... 34/602
5,115,651 A * 5/1992 Nukaga et al. ..... 68/17 R
5,709,109 A * 1/1998 Cho ..... 68/23.2
6,464,767 B1 * 10/2002 Evans et al. ..... 106/31.5
2004/0244168 A1 * 12/2004 Lee ..... 29/283.5

FOREIGN PATENT DOCUMENTS

DE 201 19 096 U1 4/2002
NL 264558 6/1964

* cited by examiner

*Primary Examiner*—Frankie L Stinson
*Assistant Examiner*—Samuel A Waldbaum
(74) *Attorney, Agent, or Firm*—Hogan & Hartson LLP

(57) ABSTRACT

A basket (6) for loading the laundry in a washing machine, washer-drier, drier and the like comprises a innerly hollow body with a longitudinal axis (X) being the basket (6) rotation axis, wherein said body has at least one shaped length (12) the radial distance (r, r14, r15) thereof from the longitudinal axis (X) is increased towards the rear wall (8) such that the barycentre of the inner volume (10) being defined by the hollow body is displaced towards the rear wall (8), wherein in the shaped length (12) there are formed one or more steps (13) extending along a circumpherential direction to the longitudinal axis (X) each providing an increase in the radial distance (r, r14, r15) of the shaped length (12) from the longitudinal axis (X) and wherein the step defines at least two portions (14, 15) having different radial distances (r, r14, r15) from the longitudinal axis (X).

19 Claims, 4 Drawing Sheets

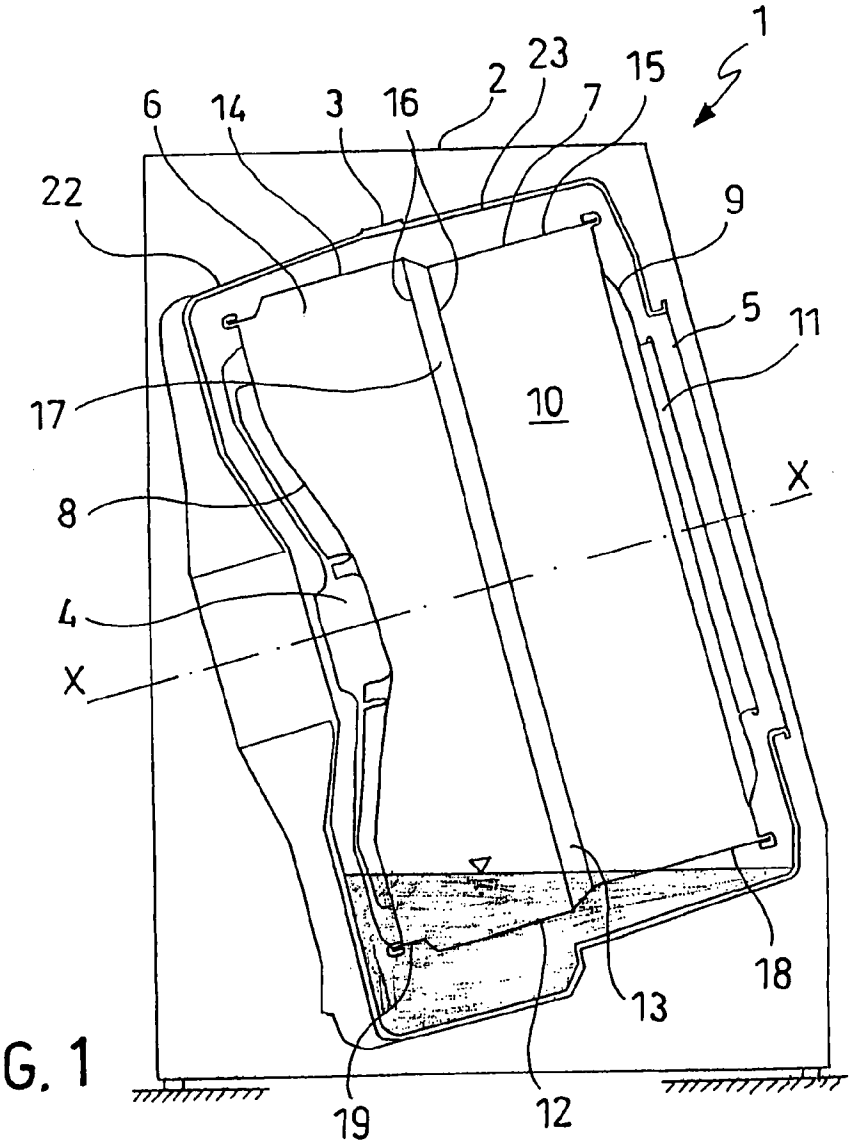
FIG. 1
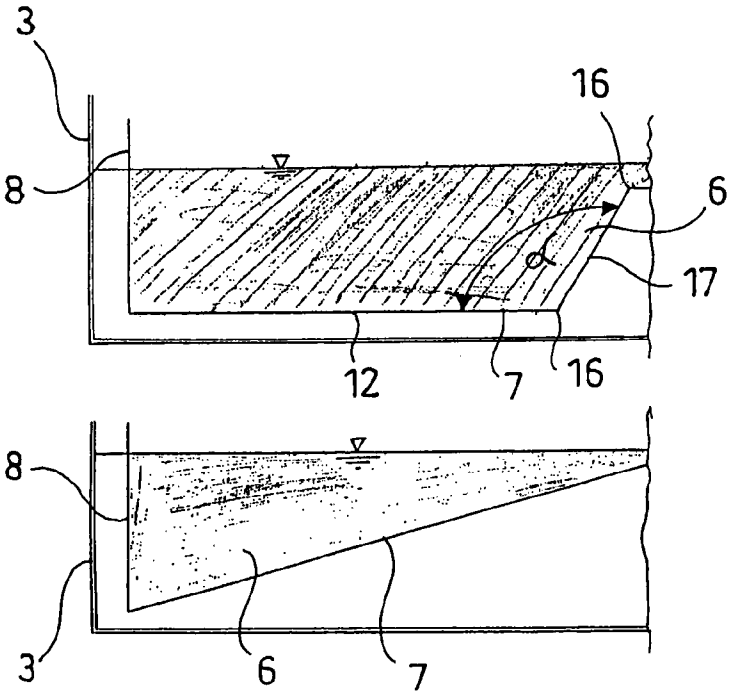
FIG.10
FIG.11

BASKET FOR WASHING MACHINE, WASHER-DRIER, DRIER, AND THE LIKE

FIELD OF THE INVENTION

The present invention generally relates to the field of domestic appliances, and more particularly to the household washing machines field, particularly washing machines or washer-driers, driers, and the like.

BACKGROUND OF THE INVENTION

A washing machine is known to comprise a washing tank intended to contain the washing or rinsing liquid therein, which houses a laundry-loading basket rotating within the tank under the action of motor means. The tank is a body of a generally cylindrical shape, with a longitudinal axis, made of stainless steel or plastic, with a side wall extending along the longitudinal axis, a rear wall and a front wall transversal to the longitudinal axis, and an aperture in the front wall, in those washing machines of the front loading type, or on top of the side wall, in those washing machines of the top loading type, providing access to the inside of the tank. The basket is a mainly cylindrical body made of stainless steel, having a constant diameter along its longitudinal axis, which coincides with the longitudinal axis of the tank and acts as the rotation axis of the basket within the tank. It is also provided with a side wall extending along the axis, a rear wall and a front wall transversal to the axis, and an aperture, either in the front wall or side wall, being arranged such as to match the aperture in the tank, in order to provide access therein for loading and unloading the laundry. The tank axis, and accordingly the basket rotation axis, is normally horizontal; however, washing machines of the front loading type exist in which the tank axis, and accordingly the basket rotation axis, is biased relative to the horizontal axis, such that the tank and basket front walls are at a higher level than the respective bottom walls. Within the basket side wall there are also provided holes such that the washing or rinsing liquid contained in the tank may pass into the basket such that the laundry within the basket is wet by this liquid.

Upon operation, washing or rinsing liquid is supplied to the tank. The washing or rinsing liquid, which accumulates by gravity on the bottom of the tank, penetrates within the basket through the holes provided within the side wall thereof. The laundry contained in the basket is thereby wet by the washing or rinsing liquid obviously, since the surface of the washing or rinsing liquid arranges itself parallel to the ground, i.e. is substantially horizontal, in those washing machines with horizontal axis tank, and accordingly basket, the washing liquid level is constant within the basket all along the axis of the basket itself. Furthermore, according to the widespread trend of reducing the amount of washing liquid employed (to limit water consumption, electric power for water-heating purposes, and detergent consumption), this level is generally low. This makes it difficult to suitably wet all the laundry as desired, and sometimes it requires to provide water recirculation circuits within the washing machine with spraying nozzles placed in the basket.

On the other hand, in those washing machines with biased axis tank, the level of washing liquid in the basket is not the same all along the basket axis, and an accumulation of liquid is found at the lowermost basket area, in the proximity of the rear wall.

The basket rotating within the tank, particularly upon spinning, entails eccentric oscillations of the basket due to an unperfectly even distribution of the laundry contained therein. To avoid that these oscillations may cause the basket to hit the tank, suitable minimum distances are required between the basket and the washing tank.

On the one hand, said minimum distances entail the arrangement of an additional water volume outside the basket, which is therefore not used, and on the other hand the reduction of the basket inner volume with the size of the washing tank being equal.

To increase the volume within the basket, the use of truncated-cone shaped baskets has been suggested, the front diameter of which (away from the support point) is smaller than the rear diameter (at the support cross frame fixed to the basket rear wall), such that the basket has a small dimension only in the area away from the support point, where the width of deformations and vibrations is the greatest.

This solution has the drawback that the centrifugal force acting on the laundry and the basket side wall deforms the latter outwardly with a barrel-shape and that, in the central area of the basket-tank unit, the opening between the washing tank and the basket must be increased by the deformation value of the side wall.

Furthermore, the conical bias of the side wall causes the laundry to be deeply immersed into the washing liquid only at the basket rear wall, the immersion depth rapidly decreasing towards the basket front wall.

Finally, the taper of the basket causes the side wall thereof to be biased relative to the rotation axis, which favours a displacement (axial, at first) of the laundry upon spinning. This displacement of the laundry is not desired, since it entails changes and unbalancing of the mass and inertia distribution of the loaded basket, which in turn increase the oscillations of the basket.

SUMMARY OF THE INVENTION

In view of the prior art described above, it is an object of the present invention to provide a basket for washing machines, washer-driers, driers and the like which is structurally and operatively suitable to overcome the above-mentioned drawbacks.

In accordance with the present invention, this object is achieved by a laundry-loading basket comprising an innerly hollow body with a longitudinal axis being the basket rotation axis, wherein said body has a rear wall to be fixed to a support structure of basket and a front wall opposite to the rear wall, both rear and front walls being transversal to the longitudinal axis, as well as a side wall extending about the longitudinal axis and is connected to said rear and front walls to form said hollow body, wherein the side wall comprises at least one shaped length the radial distance thereof from the longitudinal axis being increased towards the rear wall such that the centre of gravity of the inner volume defined by the hollow body is displaced towards the rear wall, wherein in the shaped length there are formed one or more steps extending along a circumferential direction to the longitudinal axis, each providing an increase in the radial distance of the shaped length from the longitudinal axis and wherein said one or more steps define at least two portions of the side wall having a different radial distance from the longitudinal axis.

BRIEF DESCRIPTION OF THE DRAWINGS

The characteristics and the advantages of the present invention will be better understood from the following detailed description of some possible embodiments thereof, which are provided by way of non-limiting examples and illustrated in the annexed drawings, in which:

FIG. 1 is a sectional schematic view, according to a vertical midplane, of a washing machine;

FIGS. 10 and 11 show a comparison between the immersion volumes in the washing liquid according to the invention (FIG. 10) and according to the prior art (FIG. 11).

DETAILED DESCRIPTION OF PREFERRED EMBODIMENTS

Figure 3:
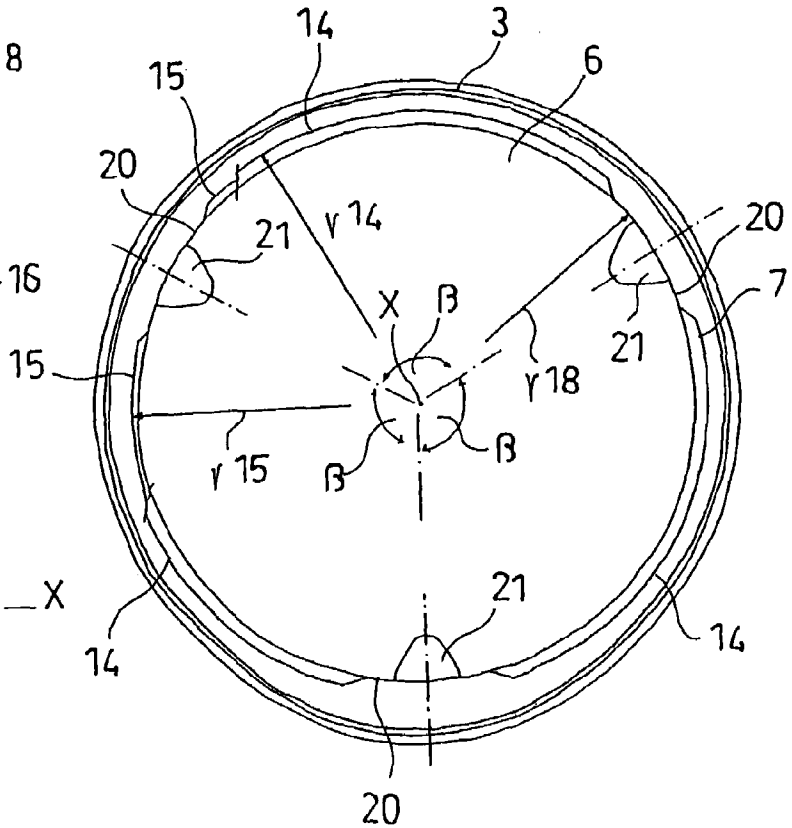
FIG. 3 is a multiple-plan cross-sectional view of the basket-tank unit from FIG. 2.

With reference to the figures, in FIG. 1 there is schematically illustrated a washing machine, of the front loading type, with a biased-axis tank. Particularly, the washing machine, being indicated with 1 as a whole, comprises a cabinet 2 for a tank 3 to be housed therein, which consists of a generally cylindrical body, either made of plastic or stainless steel, having a biased longitudinal or horizontal X axis (such as illustrated in FIG. 1). The tank 3 is coupled to the cabinet 2 by means of known means, comprising shock-absorbers and suspension springs, which are not shown to avoid loading the drawing.

The tank 3 is provided with a front aperture 5, having a generally rounded shape, which can be closed by a porthole being frontally hinged to the cabinet 2, not shown as known per se. Within the tank 3, a basket 6 is housed rotatably about X axis for the laundry to be accommodated therein to be washed and/or dried. The basket 6 comprises a side wall 7, a rear or bottom wall 8 and a front wall 9. The walls 7, 8 and 9 define an inner space 10 intended to house the laundry to be washed and/or dried. The front wall 9 of basket 6 is a stainless steel or plastic ring, with an aperture 11 having a generally rounded shape being placed such as to match the aperture 5 of tank 3 for access to the inner space 10 to load and unload the laundry.

The rear or bottom wall 8 of basket 6 is preferably a substantially flat and centrally-drawn steel disc, being concave towards the outside of the basket. In the middle of the rear wall 8 of basket 6 there is mounted a support hub 4 for the basket itself, through which the basket is operatively connected to motor means (not shown) controlling the rotation thereof about the longitudinal axis X.

The side wall 7 of the basket is preferably obtained by a flat steel sheet which is folded such as to form an approximatively rotational surface around a longitudinal central axis, being coincident with the longitudinal axis X of the tank 3 when in use.

The coupling of the bottom 8 and front 9 walls to the side wall 7 is preferably provided by folding two end lengths 18, 19 of the sheet being the side wall 7, such as to give a C-shaped profile to the steel plate, at both ends thereof. The bottom 8 and front 9 walls are shaped such as to define, at the respective outer edges, complementary profiles with the C-shaped profile formed at both end lengths 18, 19 of the side wall 7.

The side wall 7 comprises at least one shaped length 12, the radial distance r thereof from longitudinal axis X being increased towards the rear wall 8 or, in other words, the radial distance r from the longitudinal axis X being decreased towards the front wall 9, such that the barycentre of the inner volume defined by the hollow body is displaced towards the rear wall 8 or, in other words, said barycentre of the basket inner volume is arranged at the rear half of the basket relative to the central longitudinal extension thereof along X axis.

In the shaped length 12 there are formed one or several steps 13 extending along a circumpherential direction to longitudinal axis X, each to provide a substantially sudden increase of the radial distance r from longitudinal axis X, which steps define at least two portions 14, 15 of the side wall 7 having different radial distances r14, r15 from the longitudinal axis X.

In accordance with an embodiment, at least one, preferably each of the portions 14, 15 of the side wall 7 has a radial distance r14, r15 from the longitudinal axis X which is substantially the same along said longitudinal axis X. Advantageously, either said portion or all of portions 14, 15 of the side wall 7 have a substantially cylindrical shape.

According to a further embodiment, at least one of portions 14, 15 has a radial distance r14, r15 from the longitudinal axis X varying along the longitudinal axis X, thus conferring a substantially cone-truncated shape to the portion 14, 15 of interest.

In this case, the radial distance r of portions 14, 15 of the side wall 7 from the longitudinal axis X decreases in the direction of the front wall 9 of the basket, thus giving a tapered stepped shape to the shaped length 12 of the side wall 7.

The steps advantageously comprise two folding edges 16 which are substantially parallel and oriented in a substantially opposite way such as to define therebetween a transition portion 17 between both adjacent portions 14, 15 of the side wall 7. The extension of the transition portion 17 in the direction of the longitudinal axis X is advantageously smaller than the corresponding extension of each of both adjacent portions 14, 15 defining with the transition portion 17 preferably an obtuse angle $\alpha$ of between 95° and 165°, preferably 120° and 150°, advantageously about 135°.

The end lengths of the side wall 7, i.e. a front length 18 connecting to the front wall 9 and a rear length 19 connecting the rear wall 8 of basket 6 have a substantially cylindrical shape and have advantageously the same diameter r18=r19.

In accordance with an advantageous embodiment, such as illustrated in FIGS. 3, 6, 7 and 8, the radial distance r of side wall 7 from the longitudinal axis X varies in the circumpherential direction of the side wall 7 relative to the longitudinal axis X. The side wall 7 particularly comprises one or more longitudinal lengths 20 substantially without steps, substantially extending from the rear length 19 to the front length 18 of side wall 7 and to which there are preferably fixed one or more laundry-dragging blades 21.

The shaped lengths 12 are formed in the areas defined between these longitudinal lengths 20, such that the steps 13 do not interfere with the areas connecting the dragging blades 21.

In accordance with an embodiment such as represented in FIGS. 3, 6, 7 and 8, the longitudinal lengths 20 are substantially rectilinear, thus allowing the use of traditional rectilinear dragging blades 21.

Figure 9:
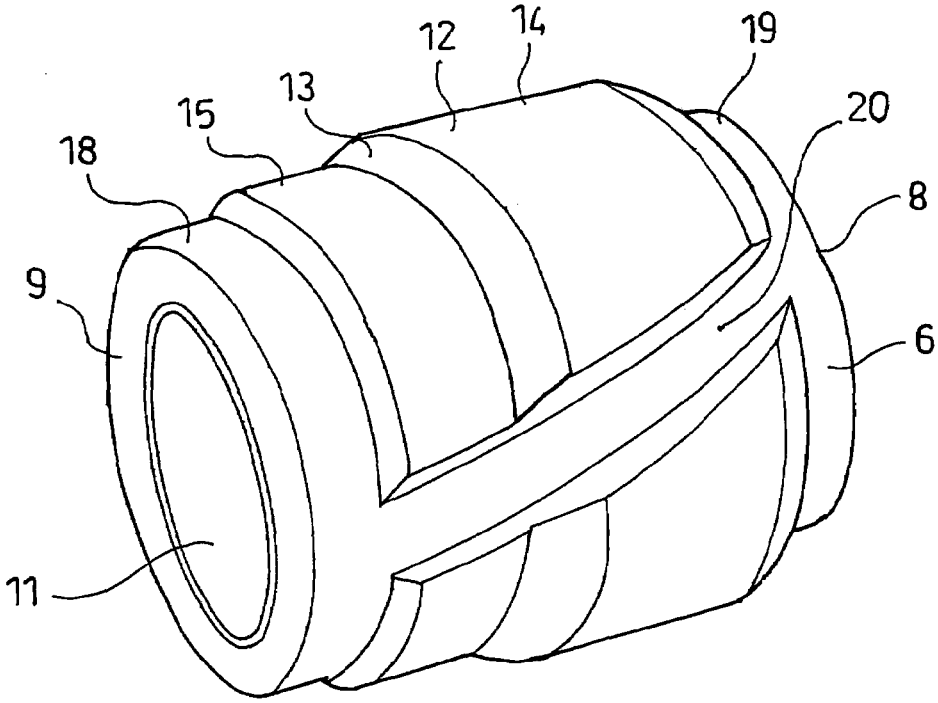

Alternatively, the longitudinal lengths 20 are substantially helicoidal, such as shown in FIG. 9. Such a configuration facilitates the assembly of biased or helicoidal dragging blades suitable to increase the capacity of basket 6 to mix and whirl the laundry.

Figure 8:
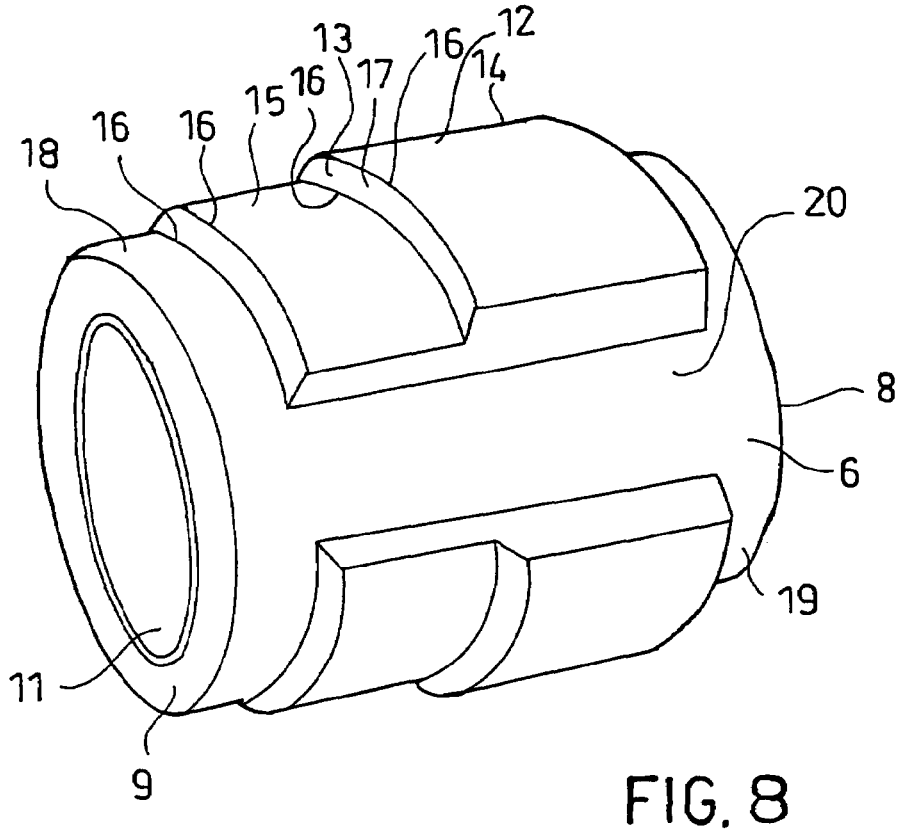

According to an embodiment, the longitudinal lengths 20 form a cylinder-sectioned structure, with a radial distance r from longitudinal axis X being substantially constant along the longitudinal axis X, such as shown in FIGS. 3 and 8.

Figure 7:
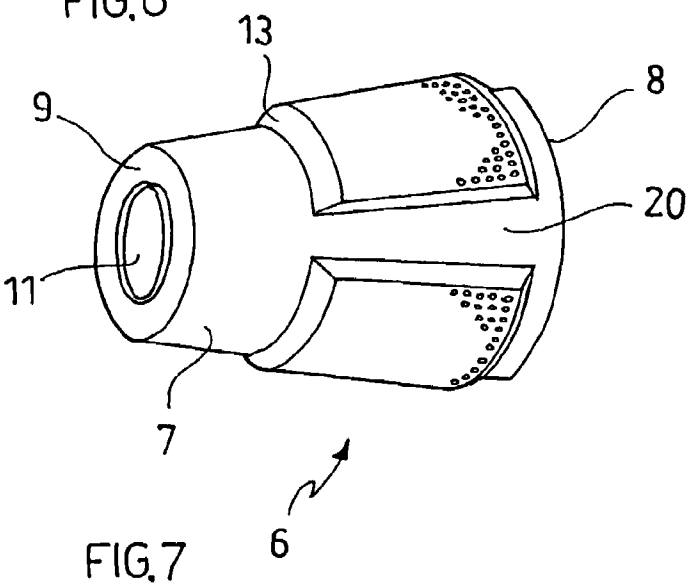
Figure 4:
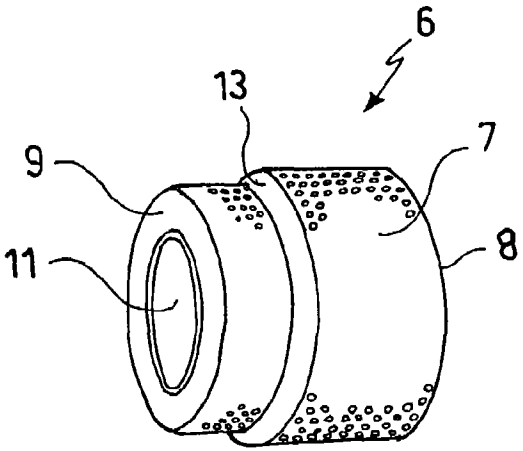
Figure 5:
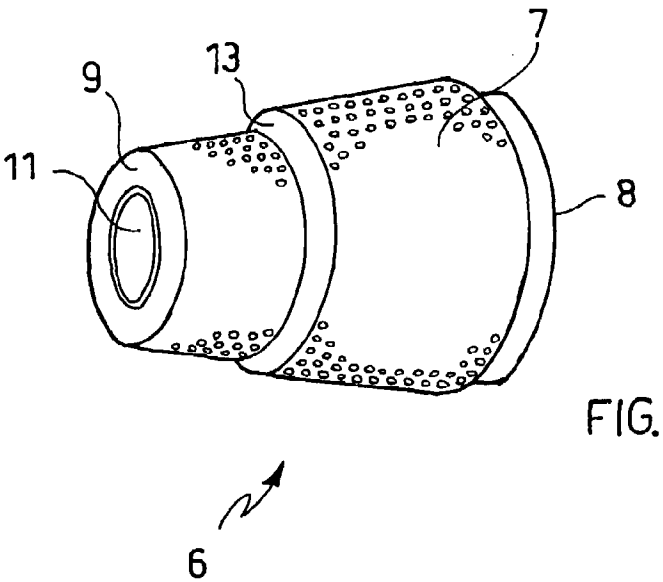

Alternatively, the longitudinal lengths have a radial distance r from longitudinal axis X decreasing towards the front wall 9 of basket 6, thus forming for example a truncated-cone sectioned structure, such as represented in FIG. 7.

Advantageously, the basket 6 comprises three equidistant longitudinal lengths 20 defining angles β of about 120° there between and three dragging blades 21, each being arranged at one of the three longitudinal lengths 20.

As stated above, the side wall 7 is preferably formed by one single metal sheet, preferably stainless steel, continuous at the steps 13 and subjected to bending, calendering or cold-expansion mechanical strain to obtain said shaped length 12 tapered towards the front wall 9.

Figure 2:
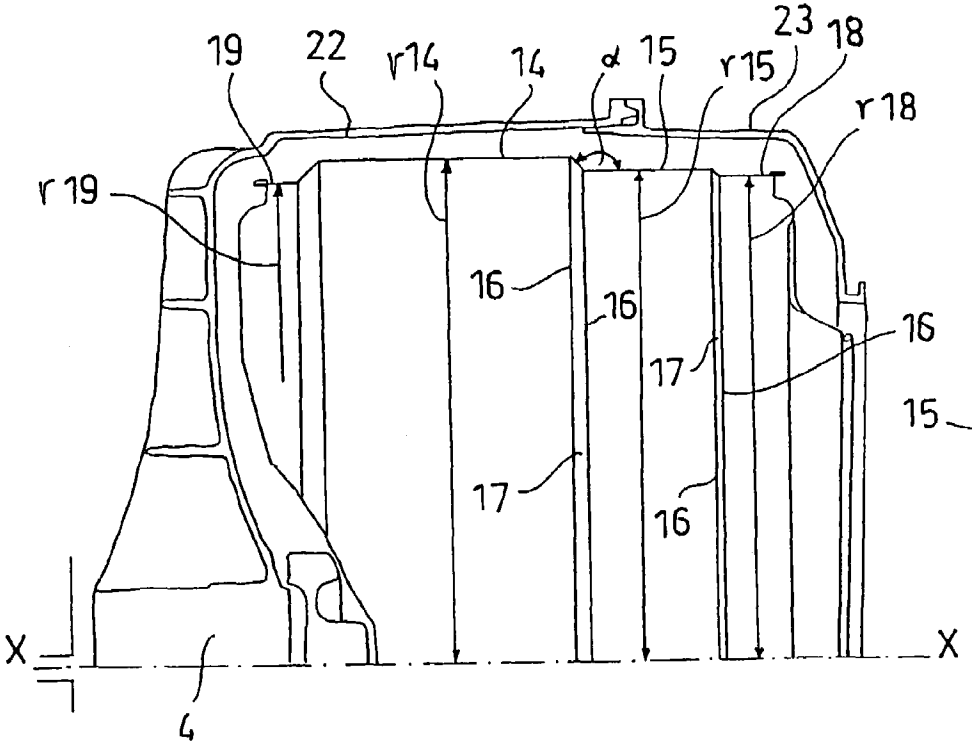
FIG. 2 is a partial sectional view of a basket-tank unit in accordance with an embodiment of the invention.
Figure 6:
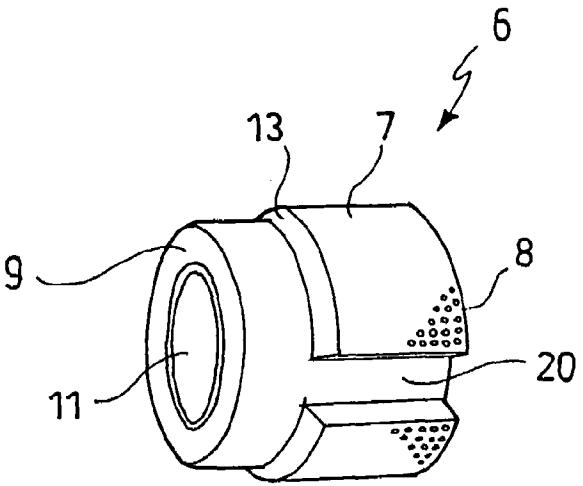
FIGS. 4 to 9 are schematic perspective views of further embodiments of the invention.

As may be seen for example in FIGS. 1 and 2, in the basket-tank unit according to the invention, the clearance, i.e. the minimum distance between the side wall 7 of basket 6 and tank 3 at the front of basket 6 is greater than the corresponding clearance at the rear of the basket, thus entailing a high exploitation of the tank volume without hindering any deformation or oscillation of the basket.

Advantageously, the washing tank 3 comprises a rear half-shell 22 housing the rear wall 8 and part of the side wall 7 of the basket and a front halfshell 23 housing the front wall 9 and part of the side wall 7 of the basket. Both halfshells 22, 23 are preferably manufactured separately and connected to each other upon assembly of the basket-tank unit. Thereby, only one type of rear halfshell 22 can be used for basket-tank units having different depth and volume capacity which can be modularly connected to one of a front halfshell set 22 having different depths (i.e. lengths).

The laundry basket according to the present invention has a number of advantages.

By widening the basket towards the rear wall thereof by means of steps 13 allows to shape the adjacent portions 14, 15 such that the laundry can be immersed deeper in the washing liquid, as it can be seen by comparing FIG. 10 with FIG. 11 (prior art), and further prevents the inadverted displacement of the laundry upon the spinning cycle.

The steps 13 further provide reinforcement and stiffening means for the side wall 7, which, thickness being equal, has reduced strains and a lower tendency to vibrate.

The basket and the basket-tank unit according to the invention provide an effective volume increase within the basket, tank overall bulk being equal, a lower water consumption as a consequence of the reduction of the additional volume due to the safety distance between the basket and the tank, as well as a reduction in the oscillation width of the basket, because the laundry is mostly gathered in the rear area of the basket in the vicinity of the support point thereof.

It should be understood that variants and/or additions to what has been described and illustrated above may be provided. First of all, the present invention not only may be applied in laundry washing machines with biased-axis tank, such as those of the examples above, but also in laundry washing machines with horizontal-axis tank, in washer-driers and drying machines.

Further variants and/or additions will be readily apparent to those skilled in the art, without departing from the scope of protection being defined in the annexed claims.

What is claimed is:

1. A basket and tank unit for loading the laundry in a washing machine of the type comprising a washing tank for containing washing or rinsing liquid and a laundry loading basket rotatably housed within the tank, said basket and tank unit comprising a tank and a basket which is housed inside the tank and rotatable with respect to said tank about a basket rotation axis, said basket comprising an innerly hollow body with a longitudinal axis being said basket rotation axis, wherein said body has a rear wall fixed to a support structure of said basket and a front wall opposite to the rear wall, both rear and front walls being transversal to the longitudinal axis, as well as a side wall extending about the longitudinal axis and connected to said rear and front walls to form said hollow body, wherein the basket and tank unit defines a free and unobstructed clearance between said side wall of said rotatable basket and said washing tank, wherein the side wall comprises at least one shaped length the radial distance thereof from the longitudinal axis being increased towards the rear wall such that the barycenter of the inner volume defined by the hollow body is displaced towards the rear wall, wherein in the shaped length there are formed one or more steps extending along a circumferential direction to the longitudinal axis, each step providing an increase in the radial distance of the shaped length from the longitudinal axis and wherein said one or more steps define at least two portions of the side wall having a different radial distance from the longitudinal axis, wherein the basket and tank unit define a free and unobstructed clearance between said tank and said side wall of said rotatable basket, said free and unobstructed clearance being configured to allow oscillation movement of the rotatable basket relative to the washing tank, said basket and tank unit being further configured such that said free and unobstructed clearance can contain part of said washing liquid, said basket and tank unit being shaped such that said free and unobstructed clearance between said tank and said side wall of said rotatable basket increases from a rear part of said basket to a front part of said basket, and in which said steps in said shaped lengths of said basket side wall determine a stepwise increase of said free and unobstructed clearance.

2. The basket and tank unit according to claim 1, wherein each of the portions has a substantially cylindrical shape.

3. The basket and tank unit according to claim 1, wherein said one or more steps comprise two folding edges substantially parallel and oriented in substantially opposite directions such as to define between said two folding edges a transition portion between two adjacent portions of the side wall.

4. The basket and tank unit according to claim 3, wherein the extension of the transition portion in the direction of the longitudinal axis is smaller than the extension of each of the adjacent portions in said direction of the longitudinal axis.

5. The basket and tank unit according to claim 3, wherein the transition portion defines an obtuse angle with each of the portions.

6. The basket and tank unit according to claim 5, wherein the angle is comprised between 95° and 165°.

7. The basket and tank unit according to claim 6, wherein the angle is of about 135°.

8. The basket and tank unit according to claim 1, wherein said side wall comprises a substantially cylindrical rear length connected to the rear wall and a substantially cylindrical front length connected to the front wall, wherein said rear and front lengths have the same diameter.

9. The basket and tank unit according to claim 1, wherein the radial distance (r) of the side wall from the longitudinal axis varies in the circumferential direction of the side wall about the longitudinal axis.

10. The basket and tank unit according to claim 9, wherein the side wall comprises one or more longitudinal lengths without steps, substantially extending from a rear length of the side wall for connection to the rear wall until a front length of the side wall for connection to the front wall, wherein said one or more shaped lengths are formed between said one or more longitudinal lengths.

11. The basket and tank unit according to claim 10, wherein said longitudinal lengths are substantially rectilinear.

12. The basket and tank unit according to claim 10, wherein said longitudinal lengths are substantially helical.

13. The basket and tank unit according to claim 10, comprising one or more laundry-dragging blades being arranged at said longitudinal lengths.

14. The basket and tank unit according to claim 10, wherein said longitudinal lengths have a radial distance (r) from the longitudinal axis being substantially constant all along the longitudinal axis.

15. The basket and tank unit according to claim 10, comprising three equidistant longitudinal lengths, defining angles (β) of about 120° therebetween and three dragging blades arranged at said three longitudinal lengths.

16. The basket and tank unit according to claim 1, wherein the side wall is formed by one single metal sheet, preferably stainless steel, being continuous at the steps.

17. The basket and tank unit according to claim 16, wherein the single metal sheet is subjected to bending, calendering or cold expansion mechanical strain in order to obtain said shaped length.

18. The basket and tank unit according to claim 1, comprising an aperture for loading the laundry being formed in the front wall.

19. The basket and tank unit according to claim 1, wherein said tank comprises a rear halfshell housing the rear wall and part of the side wall of the basket and a front halfshell housing the front wall and part of the side wall of the basket, the rear and front halfshells being manufactured separately and connected upon assembly of the basket-tank unit.

* * * * *